United States Patent [19]

Alexandrovich

[11] Patent Number: 4,507,377

[45] Date of Patent: Mar. 26, 1985

[54] SELF-FIXING LIQUID ELECTROGRAPHIC DEVELOPERS

[75] Inventor: Peter S. Alexandrovich, Rochester, N.Y.

[73] Assignee: Eastman Kodak Company, Rochester, N.Y.

[21] Appl. No.: 448,885

[22] PCT Filed: Apr. 8, 1982

[86] PCT No.: PCT/US82/00435

§ 371 Date: Nov. 19, 1982

§ 102(e) Date: Nov. 19, 1982

[51] Int. Cl.[3] ..... G03G 9/12

[52] U.S. Cl. ..... 430/115; 430/116

[58] Field of Search ..... 430/106, 112, 114, 116, 430/115

[56] References Cited

U.S. PATENT DOCUMENTS 3,939,085 5/1973 Smith et al. .
3,954,640 6/1973 Webster et al. .
4,052,325 10/1977 Sawtilli ..... 430/114
4,202,785 5/1978 Merrill et al. .

FOREIGN PATENT DOCUMENTS 2003620 8/1978 Australia .
2313547 3/1973 Fed. Rep. of Germany .
897903 12/1958 United Kingdom .
1110225 4/1964 United Kingdom .

*Primary Examiner*—John E. Kittle
*Assistant Examiner*—John L. Goodrow
*Attorney, Agent, or Firm*—Torger N. Dahl

[57] ABSTRACT

A liquid electrostatic image developer is disclosed which forms self-fixing images on an electrostatic image-bearing surface which may be the image-forming surface. The developer comprises a plurality of particles composed of a compatible blend of at least one polyester resin and at least one polyester plasticizer. The plasticizer contains essentially no curable groups and is insoluble in the liquid carrier. Furthermore, images from certain preferred developers containing dispersed colorants are crack-resistant in addition to self-fixing.

15 Claims, No Drawings

SELF-FIXING LIQUID ELECTROGRAPHIC DEVELOPERS

The present invention relates to self-fixing liquid electrostatic image developers comprising as a dispersed component, a compatible blend of at least one polyester binder and at least one polyester plasticizer, to images formed from such developers, and to methods of forming images with such developers.

Electrographic imaging and development processes have been extensively described in both the patent and other literature. Generally, these processes having common the steps of forming an electrostatic charge image, often called an electrostatic latent image, on an insulating surface, such as a photoconductive insulating layer coated on a conductive support. The electrostatic latent image is then rendered visible by a development step in which the charge image-bearing surface is brought into contact with a suitable electrostatic image developer composition which deposits toner particles on either the charged or uncharged image areas. After development, the visible image is either heat-fixed directly to the electrostatic charge-bearing surface or it is transferred to another surface such as paper where it is there heat-fixed.

Liquid developer compositions of the type described in U.S. Pat. No. 4,202,785 are very useful for developing latent electrostatic images. These developers comprise stable dispersion of dispersed components and dissolved components in an electrically insulating carrier liquid. The dispersed components include charged particles, known as toner particles, comprising a colorant or pigment, such as carbon black, generally associated with a thermoplastic resin binder. The dissolved components include optional organic liquids from previous steps in the preparation of the liquid developer, as well as optional charge control agents.

Liquid developers containing polyester resin binders such as those disclosed in the aforementioned U.S. Pat. No. 4,202,785 as well as developers containing other polyester resin binders are particularly useful. As noted in the said U.S. patent, however, the polyesters are fixed to receiving surfaces by the application of heat. Heat-flexible polyesters having very high glass transition temperatures ($T_g$), (i.e., above 150° C.) thus require higher fixing temperatures as well as careful selection of the receiving support to avoid support distortion or charring.

In the published patent literature, various liquid toner formulations having self-fixing qualities are reported. For example, U.S. Pat. No. 3,954,640 reports the use of low $T_g$ linear addition polymers to give liquid developers and inks that become fixed to a substrate with little or no carrier evaporation in the absence of heat. It is essential to this patent that the polymer $T_g$ be no higher than 35° C. The patent further discloses the use of monomeric plasticizers as optional components that are miscible in the carrier. The purpose of the plasticizer is to adjust the ability of the carrier to disperse the polymer resin.

U.K. Pat. No. 1,110,225 describes a liquid developer which is said to be self-fixing upon removal of the carrier liquid following deposition of the toner particles. To achieve such self-fixing, the patent discloses the use of liquid alkyd resins which, because of their unsaturated chemical bond linkages, cure in air upon removal of the carrier liquid. Toner particles containing oxidizing type unsaturated alkyd resins in combination with certain phenol modified pentaerythritol ester resins are also noted in U.K. Pat. No. 897,903.

Also from the patent literature, the use of certain plasticizers is reported in liquid toner formulations for purposes entirely unrelated to self-fixing. Thus, for example it is reported that toner adhesion to a substrate can be achieved by tack modification. That is, through the addition of modifying agents, a resin binder can be rendered suitably tacky to adhere to a surface of choice. According to U.S. Pat. No. 3,939,085 the addition of monomeric plasticizers to toner resins produces a toner composition that has low adhesion for an image-forming surface and high adhesion for a copy surface. The adhesion differential facilitates transfer of toner images from the image-forming surface to the copy where the tack quality is lost by curing. From the teachings of this patent, therefore, it would appear that the use of plasticizers will not produce a toner that self-fixes to an image-forming surface.

U.K. Patent Application No. 2,003,620A relates to the use of carrier-soluble monomeric and polymeric plasticizing agents for the toner binder resin. The use of carrier-soluble plasticizers, however, is undesirable as they tend to leach out of the binder resin into the carrier, thus negating any potential benefit from their use. Furthermore, this document does not teach that its toners are self-fixing.

In accordance with the present invention, a self-fixing liquid electrographic developer is provided exhibiting, in its broadest aspects, several significant advantages. The developer is self-fixing without resort to tacky low $T_g$ binder polymers. The self-fixing property, moreover is exhibited specifically on an electrostatic image-bearing surface without fear of unwanted transfer to other surfaces. Furthermore, the liquid developer exhibits its self-fixing property immediately upon extraction of the image-bearing surface or element from the liquid development region, in contrast to the prior art methods relying upon further chemical reaction of included curing agents having unsaturated chemical groups.

These and other advantages are achieved with a liquid electrographic developer composition which self-fixes to an electrostatic image-forming surface.

According to the present invention there is provided a liquid electrostatic image developer composition comprising an electrically insulating organic carrier liquid containing, as a dispersed constituent, a plurality of toner particles comprising a compatible blend of at least one polyester resin and at least one polyester plasticizer, characterized in that the plasticizer is substantially free of curable groups and is substantially insoluble in the carrier liquid.

Self-fixing in the context of the present invention denotes the quality of forming a rub resistant image on an electrostatic image-bearing surface without resort to externally applied heat. The self-fixing property, moreover, is substantially immediate, after the image-bearing surface is treated in and removed from the liquid developer, and any residual carrier evaporated to dryness. To determine whether a particular developer meets the self-fixing criteria of the present invention one can employ a simple test to determine rub resistance. The rub test comprises the application of a 700 gram weighted oleic acid soaked patch approximately 5 mm in diameter to a toner-bearing image and oscillating a portion of the image back and forth underneath the absorbent path. Oleic acid is chosen to simulate natural finger oil. Rub resistance is determined as a range A to B, wherein A is the number of oscillatory cycles (a cycle being one movement of the patch back and forth) it takes to first interrupt the toner image integrity while B represents the number of cycles necessary to completely remove the subjected portion of the image by such rubbing. Specific toner images prepared in accordance with the present invention, exhibit an A value of from 1 to 9 cycles and a B value of from 2 to 12 cycles whereas control images having no polyester plasticizer are completely removed (B) in one cycle. In the practice of this invention, higher A-B values are, of course, likely to be obtained depending on such factors as the materials used in the compatible blend of resin and plasticizer, as well as the nature of the surface to which the blend is self-fixed.

In the practice of the present invention, a compatible blend of at least one polyester resin and at least one polyester plasticizer is used. The plasticizer is specifically free of curable groups, in contrast to prior art materials such as alkyd resins that rely on further chemical reaction of curable groups to fix. The plasticizer, moreover, is substantially insoluble in the carrier liquid so as to prevent leaching of the plasticizer into the carrier. A compatible blend in this regard, refers to the ability of the resin and plasticizer to form a non-hazy solid solution of one in the other.

The ratio of components in the compatible blend varies widely in accordance with the user needs. A useful weight ratio of plasticizer to resin is in the range from 0.2 to 1.0. A preferred ratio is in the range from 0.25 to 0.5.

Many polyester resins are useful in the practice of the present invention. Typical polyesters include repeating diol units and diacid recurring units well known to those skilled in the art. Representative polyesters are disclosed, for example in U.K. Pat. No. 1,528,950. This patent discloses a redispersible liquid developer in which the polyester binder comprises disulphonamido groups.

Preferred polyester resins of the invention include ionic polyesters comprising recurring diol units and recurring ionic diacid units. Representative preferred polyester binders have recurring diol units of the formula:

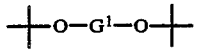

wherein: $G^1$ represents straight or branched chain alkylene having 2 to 12 carbon atoms or, substituted or unsubstituted, cycloalkylene cycloalkylenebis(oxyalkylene) or cycloalkylenedialkylene; and have up to 35 mole percent (based on the total moles of diacid units) of ionic diacid units of the formula:

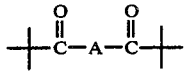

wherein: a represents sulphoarylene, sulphoaryloxyarylene, sulphocyclohexylene, arylsulphonylimino, sulphonylarylene, iminobis(sulphonylarylene), sulphoaryloxysulphonylarylene and sulphoaralkylarylene or the alkali metal or ammonium salts thereof.

Such preferred polyester resins include, for example, the polyester ionomer resins disclosed in U.S. Pat. No. 4,202,785.

In general, useful polyester resins of the present invention have a glass transition temperature ($T_g$) of from 40° C. to 100° C. Polyester resins having a $T_g$ in the aforementioned preferred range can be self-fixed to smooth-surfaced dielectric coated receiving elements, as well as ordinary support surfaces, such as photoconductive coated paper or film elements, without difficulty.

Materials having a $T_g$ above 150° C. can also be used.

The glass transition temperatures can be determined by conventional methods, such as differential scanning calorimetry (DSC).

Useful polyester resins have an inherent viscosity of 0.01 to 0.65, preferably 0.16 to 0.31. Polyester resins having inherent viscosities in the preferred range are compatible with the preferred charge control agents, optionally used in the liquid electrographic developers of the present invention. Inherent viscosities of the polyesters are measured in a 1:1 by weight solution of phenol:chlorobenzene at 25° C. at a concentration of 0.25 gram per 100 ml of solution.

The plasticizers employed in the compatible blend of resin and plasticizer are chosen from among a variety of commercially available polyester plasticizers having a $T_g$ below −40° C., preferably within the range from about −45° C. to about −70° C. In selecting suitable material, the criteria of compatibility with the polyester binder is usually first employed to screen potentially useful materials. From among these materials that satisfy the compatibility criteria, one then excludes plasticizers having curable chemical groups such as oil-modified polyester plasticizers or epoxidized oils. Of the eligible plasticizers, ones are chosen that are insoluble in the electrically insulating carrier liquid as defined below.

Representative useful polyester plasticizers that are insoluble in commonly employed isoparaffinic hydrocarbon carrier liquids such as that sold under the trade mark 'Isopar' G are listed in the following table by Trade Mark and commercial source.

TABLE I

| Plasticizer | Commercial Source |
|---|---|
| 'Santicizer' 429 | Monsanto Chemical Co. |
| 'Santicizer' 409 | Monsanto Chemical Co. |
| 'Paraplex' G-25 | Rohm and Haas Co. |
| 'Paraplex' G-41 | Rohm and Haas Co. |
| 'Paraplex' G-57 | Rohm and Haas Co. |
| 'Paraplex' G-31 | Rohm and Haas Co. |
| 'Paraplex' G-40 | Rohm and Haas Co. |
| 'Eastman' NP-10 | Eastman Kodak Co. |

Preferred polyester plasticizers include those sold under the Trade Marks 'Santicizer' 429, 'Paraplex' G-25, 'Paraplex' G-41 and 'Paraplex' G-57. 'Santicizer' 429, typifying the preferred materials, has the following physical properties:

| | |
|---|---|
| Acidity | 4.0 meq/100 gm max |
| Refractive Index at 25°C. | 1.460 to 1.470 |
| Specific Gravity 25°/25°C. | 1.080 to 1.110 |
| Density (25°C.) ca. lbs./gal. | 9.1 |
| Flash point | 288°C. |
| Fire point | 310°C. |

-continued

| | |
|---|---|
| Insoluble in water at | 25°C. |
| $T_g$ | −56°C. |

Preferred polyester plasticizers comprise repeating alkylene diol units having 2 to 6 carbon atoms such as diol units derived from ethylene glycol or butylene diol, and repeating aliphatic diacid units having 3 to 10 carbon atoms such as diacid units derived from malonic acid, succinic acid or adipic acid. A particularly preferred polyester plasticizer comprises an acetate terminated adipic acid-butylene glycol polyester.

The polystyrene equivalent molecular weight of the preferred polyester plasticizers ranges from 7000 to 9000 as determined by gel permeation chromatography.

The compatible blend of resin and plasticizer defined above is formed in a variety of ways that facilitate the formation of small particles, preferably of submicron size (i.e., 0.01 to 1.0 micron average particle size). A preferred method of forming the blend comprises preparing a concentrated solution of the plasticizer and resin in a common solvent such as 'Solvesso' 200 (the trade mark for an alkylated aromatic having a major aromatic component and a boiling range of from 150°-185° C. sold by Humble Oil & Refining Co., United States of America). The concentrated solution is thereafter mixed with a large excess of the liquid carrier to precipitate particles of the plasticizer-resin blend in working developer concentration strengths.

The carrier liquid employed according to the present invention is selected from a variety of materials that satisfy the plasticizer insolubility criteria. These materials should be electrically insulating and have a fairly low dielectric constant.

Useful carrier liquids have a dielectric constant of less than 3, and a volume resistivity greater than $10^{10}$ ohm/cm. Suitable carrier liquids include halogenated hydrocarbon solvents, for example, fluorinated lower alkanes, such as trichloromonofluoromethane and trichlorotrifluoroethane, having a boiling range typically from 2° C. to 55° C. Other hydrocarbon solvents that are useful include isoparaffinic hydrocarbons having a boiling range of from 145° C. to 185° C. such as 'Isopar' G or cyclohydrocarbons, such as cyclohexane. Additional carrier liquids which are useful include polysiloxanes, odourless mineral spirits and octane.

In general, useful working strength developers of the present invention contain from 0.005 to 5% by weight of the plasticizer-resin blend. These developers contain from 99.999 to 90% by weight of the liquid carrier vehicle.

Although it is possible to use the liquid developers of the present invention without further addenda, it is often desirable to incorporate such addenda as charge control agents, waxes, and dispersing agents for the wax or colorants, in the developer.

If a colourless image is desired, it is unnecessary to add any colorant. For example, the developer may be used to form a colourless hydrophobic image in a lithographic printing process. In such case, the resultant developer composition consists essentially of the liquid carrier vehicle and the plasticizer-resin blend particles of the present invention.

In accordance with a preferred embodiment of the present invention, however, colorants, such as carbon black pigments are also included in the liquid developer defined. In this regard it has been determined that images formed from toners comprising polyester resin binder and colorants exhibit a tendency to crack in a pattern resembling that of the bed of a dried lake; the so-called adobe pattern. This tendency is significantly reduced and often eliminated with the present defined blend of resin-plasticizer. Accordingly, the present invention contemplates the use of colorant-containing developers to produce self-fixing and crack-resistant visible images. Useful results are obtained from virtually any of a wide variety of known dyes or pigment materials. Particularly good results are obtained by using various kinds of carbon black pigments.

A representative list of colorants are found, for example, in *Research Disclosure,* Vol. No. 109, May 1973, in an article entitled "Electrophotographic Elements, Materials and Processes".

The colorant concentration, when colorant is present, varies widely with a useful concentration range, by weight of the total dispersed constituents, being 10 to 90 percent. A preferred concentration range is from 35 to 45 percent.

Waxes and dispersing agents for the wax are also included as optional dispersed components in the present developers. Suitable waxes and dispersing agents include those described in U.S. patent application Ser. No. 249,330 filed on Mar. 31, 1981, by P. Alexandrovich and Upson, which describes liquid electrographic developers comprising an electrically insulating organic carrier liquid containing dispersed constituents and dissolved constituents, said dissolved constituents comprising an electrically insulating organic dispersing liquid which forms a solution with said carrier liquid, said dispersed constituents comprising at least one thermoplastic resin and wax particles, and characterized in that said developer also contains a dispersing agent for said wax particles which is insoluble in said solution of carrier liquid and dispersing liquid, but soluble in said dispersing liquid alone. Preferably the wax particles are a polyolefin wax, carnauba wax, an ester wax or an amide wax. The dispersing liquid used with these waxes is preferably an alkylated aromatic liquid when the carrier liquid is an isoparaffinic hydrocarbon.

Optionally, the developers of the present invention include various charge control agents to enhance uniform charge polarity on the developer toner particles.

Various charge control agents have been described heretofore in the liquid developer art. Examples of such charge control agents may be found in U.S. Pat. No. 3,788,995 which describes various polymeric charge control agents. Other useful charge control agents include phosphonate materials described in U.S. Pat. No. 4,170,563 and quaternary ammonium polymers described in U.S. Pat. No. 4,229,513.

Various optional non-polymeric charge control agents are also employed such as the metal salts described in U.S. Pat. No. 3,417,019. Other charge control agents known in the liquid developer art may also be employed.

A partial listing of preferred representative polymeric charge control agents for use in the present invention includes poly(styrene-co-lauryl methacrylate-co-sulphoethyl methacrylate), poly(vinyltoluene-co-lauryl methacrylate-co-lithium methacrylate-co-methacrylic acid), poly(styrene-co-lauryl methacrylate-co-lithium sulphoethyl methacrylate), poly(vinyltoluene-co-lauryl methacrylate-co-lithium methacrylate), poly(styrene-co-lauryl methacrylate-co-lithium methacrylate), poly(t-butylstyrene-co-lauryl methacrylate-co-lithium methacrylate, poly(t-butylstyrene-co-lithium methacrylate), or poly(vinyl toluene-co-lauryl methacrylate-co-methacryloyloxyethyl trimethylammonium p-toluene sulphonate).

The amount of charge control agent used will vary depending upon the particular charge control agent and its compatibility with the other components of the developer. It is usually desirable to employ an amount of charge control agent within the range of from 0.01 to 10.0 weight percent based on the total weight of a working strength liquid developer composition. The charge control agent may be added in the liquid developer simply by dissolving or dispersing the charge control agent in the liquid carrier vehicle at the time concentrates of the components are combined with the liquid carrier vehicle to form a working strength developer.

Various techniques are employed to prepare a working strength developer comprising the aforementioned plasticizer-binder blend. For example, as disclosed in U.S. Pat. No. 4,202,785, one or more developer concentrates are prepared for each of the developer components (a concentrate is a concentrated solution or dispersion of one or more developer components in a suitable electrically insulating liquid vehicle not necessarily the developer carrier liquid). The concentrates are then admixed in a preselected sequence, the admixture slurried with the carrier liquid to dilute the components, and the slurry homogenized to form the working strength developer.

The present liquid developers are employed to develop electrostatic charge patterns, carried by various types of elements. Such elements are either photoconductive themselves, i.e. image-forming surfaces, or adapted to receive charge images, i.e. image receiving surfaces, as disclosed in U.S. Pat. No. 3,519,819. For example, the developers may be used with photoconductive film elements containing arylmethane photoconductor compositions such as those disclosed in European Patent Application No. 11980.

The following examples are included for further understanding of the invention.

EXAMPLES

Preparation of Liquid Developer

The following illustrates the preparation of liquid developers in accordance with the present invention. Various concentrates each containing separate developer components in 'Solvesso' 100 alkylated aromatic liquid were prepared. Concentrates containing dispersed (insoluble) components in the 'Solvesso' 100 were solvent ball milled. The 'Solvesso' 100 concentrates included the following in approximately 10% by weight concentrations:

(A) Colorant[1] and charge control polymer
(B) Polyester resin[2]
(C) Auxiliary charge control polymer
(D) Wax[3] and dispersing agent[4] and
(E) Polyester plasticizer[5].

[1] 'Raven' 1255 carbon black available from Cities Service Company
[2] poly[neopentyl-4-methylcyclohexene-1,2-dicarboxylate-co-terephthalate-co-5-(N-potassio-p-toluene sulphonamidosulphonyl)isophthalate]
[3] Shamrock Chemicals Corporation S-394 polyethylene wax
[4] 'Elvax' 210, an ethylene/vinylacetate copolymer available from DuPont
[5] 'Santicizer' 429 polyester plasticizer available from Monsanto Chemical Co.

Preselected portions of each concentrate were admixed with sufficient 'Isopar' G isoparaffinic hydrocarbon carrier liquid and the resulting diluted mixture homogenized to form one liter of a working strength developer containing 1 part (0.7 grams) colorant per liter. The concentrations of the other components, by parts, were as follows:

| | |
|---|---|
| Colorant | 1 part |
| Charge control polymer | 1.2 parts |
| Polyester resin | 1.2 parts |
| Auxiliary charge control polymer | 0.175 part |
| Wax | 0.25 part |
| Dispersing agent | 0.125 part |
| Plasticizer | X |

where X represented varied concentrations of plasticizer in five different developers as shown in Examples 1 to 5.

EXAMPLES 1 to 5

The developers prepared as above for plasticizer concentrations X=O, 0.25, 0.375, 0.50 and 1.0 were employed to form toned images on a photoconductive recording film element without application of heat to fix the images. The film element comprises a film support, an electrically conducting layer overlying the support and a photoconductive layer overlying the conductive layer.

The resulting images were observed on a microfiche viewer screen at 24×magnification and the presence or non-presence of image cracking noted. Images of varied density for each developer were also subjected to the oleic acid rub test described above to assess their self-fixing qualities. Results are shown in Table II.

TABLE II

| Example | X (parts) | Image Density | Image Cracking | Oleic Acid Rub (A–B) Cycles |
|---|---|---|---|---|
| 1 (control) | 0 | 1.1 | Yes | 1* |
| | 0 | 0.7 | Yes | 1* |
| 2 | 0.25 | 1.2 | No | 3–5 |
| | 0.25 | 0.8 | No | 1–2 |
| 3 | 0.375 | 1.2 | No | 5–11 |
| | 0.375 | 0.8 | No | 3–6 |
| 4 | 0.5 | 1.3 | No | 4–8 |
| | 0.5 | 0.8 | No | 2–4 |
| 5 | 1.0 | 1.4 | No | 1–2 |
| | 1.0 | 0.9 | No | 1–2 |

*represented complete removal after one rub.

EXAMPLES 6 AND 7

Two developers were prepared as above having the following concentration of components

| | |
|---|---|
| Colorant | 1 part |
| Charge control polymer | 1.2 parts |
| Polyester resin | 1.2 parts |
| Auxiliary charge control polymer | 0.1 part |
| Plasticizer | X |

The developers were employed to form images as in Examples 1 to 5 and the images assessed for oleic acid rub resistance. The results are shown in Table III.

TABLE III

| Example | X (parts) | Image Density | Oleic Acid Rub (A–B) |
|---|---|---|---|
| 6 control | 0 | 1.8 | 1 |
| | | 1.0 | 1 |
| 7 | 0.5 | 2.2 | 9–25 |

TABLE III-continued

| Example | X (parts) | Image Density | Oleic Acid Rub (A–B) |
|---|---|---|---|
| | | 1.2 | 4–8 |

EXAMPLES 8 TO 10

Three developers were prepared and employed to form images as above. In each developer, carbon black was replaced with the colorant shown below:

EXAMPLE 8

| | |
|---|---|
| Cyan Blue GTNF (American Cyanamid) | 1 part |
| Charge control polymer | 0.9 part |
| Polyester resin | 1 part |
| Auxiliary charge control polymer | 0.1 part |
| Plasticizer | 0.5 part |

EXAMPLE 9

| | |
|---|---|
| 'Sunfast' Quinacridone (Sun Chemicals Co.) | 1 part |
| Charge control polymer | 0.8 part |
| Polyester resin | 1 part |
| Auxiliary charge control polymer | 0.1 part |
| Plasticizer | 0.5 part |

EXAMPLE 10

| | |
|---|---|
| Lemon Metallic Yellow (Sun Chemical Co.) | 1 part |
| Charge control polymer | 1 part |
| Polyester resin | 1 part |
| Auxiliary charge control polymer | 0.2 part |
| Plasticizer | 0.5 part |

Each of the developers was noted to exhibit self-fixing.

EXAMPLES 11 TO 15

The following developers were prepared and employed to form imges as in above Examples 1–5:

| | |
|---|---|
| Colorant | 1 part |
| Charge control polymer | 1.4 parts |
| Polyester resin | 1.2 parts |
| Auxiliary charge control polymer | 0.2 part |
| Plasticizer | X |

Five developers were prepared with values of X equal to 0, 0.125, 0.25, 0.50 and 1.0. The cracking of the images, if any, was noted as in Examples 1–5 and reported below in Table IV by severity.

TABLE IV

| Example | X (parts) | Toner Cracking |
|---|---|---|
| 11 control | 0 | Very heavy |
| 12 | 0.125 | Moderate to heavy |
| 13 | 0.25 | Slight, pinhole type |
| 14 | 0.50 | None |

TABLE IV-continued

| Example | X (parts) | Toner Cracking |
|---|---|---|
| 15 | 1.0 | None |

I claim:

1. A liquid electrostatic image developer composition comprising an electrically insulating organic carrier liquid containing, as a dispersed constituent, a plurality of toner particles comprising a compatible blend of at least one polyester resin and at least one polyester plasticizer, characterized in that the plasticizer has a glass transition temperature below −40° C. and is substantially free from curable groups and is substantially insoluble in the carrier liquid.

2. A developer according to claim 1 characterised in that the polyester resin is a polyester ionomer having ionic diacid recurring units.

3. A developer according to claim 1 or 2 characterised in that the polyester has a glass transition temperature of at least 40° C.

4. A developer according to claims 1, 2 or 3 characterized in that the polyester plasticizer comprises diol recurring units derived from alkylene diols having 2 to 6 carbon atoms and diacid recurring units derived from aliphatic diacids having 3 to 10 carbon atoms.

5. A developer according to claim 4 characterised in that the polyester plasticizer comprises butylene diol units and adipic acid units.

6. A developer according to any of the preceding claims characterised in that the weight ratio of polyester plasticizer to polyester resin is from 0.2 to 1.

7. A developer according to claim 6 characterised in that the weight ratio of polyester plasticizer to polyester resin is from 0.25 to 0.5.

8. A developer according to any of the preceding claims characterised in that the toner particles contain a colorant.

9. A developer according to claim 8 characterised in that the colorant is carbon black.

10. A developer according to any of the preceding claims characterised in that it contains a charge control agent.

11. A developer according to claim 10 characterized in that the charge-control agent is a poly(styrene-co-lauryl methacrylate-co-sulphoethyl methacrylate), poly(vinyl-tolueneco-lauryl methacrylate-co-lithium methacrylate-co-methacrylic acid), poly(styrene-co-lauryl methacrylate-co-lithium sulphoethyl methacrylate), poly(vinyltoluene-co-lauryl methacrylate-co-lithium methacrylate), poly(styrene-co-lauryl methacrylate-co-lithium methacrylate), poly(t-butylstyrene-co-lauryl methacrylate-co-lithium methacrylate), poly(t-butylstyrene-co-lithium methacrylate) or poly(vinyl toluene-co-lauryl methacrylate-co-methacryloyloxyethyl trimethylammonium p-toluene sulphonate).

12. A developer according to claim 10 or 11 characterised in that the charge control agent is present in a range from 0.01 to 10 percent by weight based on the weight of developer.

13. A developer according to any of the claims 1 to 12 characterised in that the carrier liquid is an isoparaffinic hydrocarbon.

14. The method of forming a toner image comprising treating a surface bearing an electrostatic charge image with a liquid electrostatic image developer characterised in that the electrostatic image developer is one of those claimed in claims 1 to 13.

15. A toner image bearing surface whenever made by the method of claim 14.

* * * * *